US010927723B2

(12) United States Patent
Sarati

(10) Patent No.: US 10,927,723 B2
(45) Date of Patent: Feb. 23, 2021

(54) ENGINE VALVE LIFTER ASSEMBLIES

(71) Applicant: Eaton Intelligent Power Limited, Dublin (IE)

(72) Inventor: Venkat S. Sarati, Pune (IN)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/628,411

(22) PCT Filed: Jul. 3, 2018

(86) PCT No.: PCT/IB2018/000879
§ 371 (c)(1),
(2) Date: Jan. 3, 2020

(87) PCT Pub. No.: WO2019/008445
PCT Pub. Date: Jan. 10, 2019

(65) Prior Publication Data

US 2020/0123939 A1 Apr. 23, 2020

(30) Foreign Application Priority Data

Jul. 3, 2017 (IN) ..... 201711023326

(51) Int. Cl.
*F01L 1/245* (2006.01)
*F01L 9/02* (2006.01)
(Continued)

(52) U.S. Cl.
CPC ..... *F01L 9/023* (2013.01); *F01L 1/047* (2013.01); *F01L 1/14* (2013.01); *F01L 1/146* (2013.01);
(Continued)

(58) Field of Classification Search
CPC ..... F01L 2001/054; F01L 1/14; F01L 1/146; F01L 2001/2427; F01L 2001/256;
(Continued)

(56) References Cited

U.S. PATENT DOCUMENTS 2,386,317 A * 10/1945 Jenny ..... F01L 1/245 123/90.35
2,668,524 A * 2/1954 Randol ..... F01L 1/245 123/90.55
(Continued)

FOREIGN PATENT DOCUMENTS

DE 3347680 A1 8/1984
DE 102007008573 A1 8/2008
(Continued)

OTHER PUBLICATIONS

International Search Report and Written Opinion for PCT/IB2018/000879, dated Nov. 16, 2018, pp. 1-17.

*Primary Examiner* — Jorge L Leon, Jr.
(74) *Attorney, Agent, or Firm* — Mei & Mark, LLP

(57) ABSTRACT

An engine valve lifter assembly comprises a lifter body, a plunger assembly, and a spring. The lifter body comprises an oil control portion comprising an exterior surface, oil ports, and an interior oil chamber. A plunger interface end comprises an interior plunger chamber and a second spring seat. Selectively reciprocating plunger assembly comprises a piston end coupled to reciprocate in the oil chamber and a cam input end comprising a spring seat. A spring is biased between the spring seat and the second spring seat. The spring is configured to push the cam input end away from the plunger chamber. A sleeve is coupled around the oil control portion of the lifter body, and the sleeve is slidable between a lower position and an upper position to selectively block and unblock the oil ports.

28 Claims, 18 Drawing Sheets

(51) Int. Cl.

| | |
|---|---|
| ***F01L 1/047*** | (2006.01) |
| ***F01L 1/14*** | (2006.01) |
| ***F01L 1/46*** | (2006.01) |
| ***F01L 13/00*** | (2006.01) |
| ***F01L 13/06*** | (2006.01) |
| *F01L 1/24* | (2006.01) |

(52) U.S. Cl.
CPC ..... *F01L 1/46* (2013.01); *F01L 13/0015* (2013.01); *F01L 13/06* (2013.01); *F01L 2001/2427* (2013.01); *F01L 2001/2444* (2013.01); *F01L 2001/256* (2013.01); *F01L 2001/467* (2013.01)

(58) Field of Classification Search
CPC ..... F01L 1/46; F01L 2001/467; F01L 9/023; F01L 13/06; F01L 2305/00
USPC ..... 123/90.48, 90.5, 90.52, 90.55, 90.57
See application file for complete search history.

(56) References Cited

U.S. PATENT DOCUMENTS 2,682,865 A * 7/1954 Voorhies ..... F01L 1/252 123/90.55
5,239,951 A * 8/1993 Rao ..... F01L 1/14 123/90.5
5,782,216 A 7/1998 Haas et al.
5,787,858 A 8/1998 Meneely
2003/0101953 A1* 6/2003 Hendriksma ..... F01L 1/24 123/90.16
2004/0194739 A1* 10/2004 Roe ..... F01L 1/26 123/90.5
2005/0081811 A1* 4/2005 Spath ..... F01L 1/24 123/90.48
2005/0120989 A1* 6/2005 Geyer ..... F01L 13/0005 123/90.59
2005/0183685 A1 8/2005 Kieninger et al.
2009/0145383 A1 6/2009 Baek
2009/0173302 A1* 7/2009 Evans ..... F01L 13/0005 123/90.48
2010/0050964 A1 3/2010 Haas et al.
2010/0186701 A1* 7/2010 Hicks ..... F01L 1/146 123/90.55
2012/0186546 A1* 7/2012 Cecur ..... F01L 13/0031 123/90.15
2013/0291812 A1* 11/2013 Remala ..... F01L 1/146 123/90.6
2016/0319708 A1* 11/2016 Nielsen ..... F01L 1/14

FOREIGN PATENT DOCUMENTS

DE 102008016894 A1 6/2009
WO WO-2015/002777 A1 1/2015

* cited by examiner

ENGINE VALVE LIFTER ASSEMBLIES

This is a § 371 National Stage entry of Patent Cooperation Treaty Application No. PCT/IB2018/000879, filed Jul. 3, 2018, which claims the benefit of Indian provisional application number 201711023326, filed Jul. 3, 2017, all of which are incorporated herein by reference and relied upon for the benefit of priority.

FIELD

This application provides an engine valve lifter comprising a reciprocating inner plunger. The engine valve lifter can be configured with a sleeve valve or a latching capsule for selecting among variable valve actuation techniques.

BACKGROUND

Engine braking ("EB") has been in use for some time as a rocker arm-based solution for compression release engine braking. Solutions have not been proposed for enabling engine braking via components installed inside the engine block. Instead, intricate overhead solutions have been developed.

SUMMARY

The devices and methods disclosed herein overcome the above disadvantages and improves the art by way of an engine valve lifter comprising variants of a reciprocating inner plunger. The engine valve lifter can be configured with a sleeve valve or a latching capsule for selecting among variable valve actuation techniques. Additional functionality can be configured by including a hydraulic lash adjuster. And, the lifter can be configured between a flat tappet style and a roller-lifter style.

An engine valve lifter assembly comprises a lifter body, a plunger assembly, and a spring. The lifter body comprises an oil control portion comprising an exterior surface, oil ports, and an interior oil chamber, wherein the oil ports pass from the exterior surface, through the lifter body, and to the oil chamber of the lifter body. A plunger interface end comprises an interior plunger chamber and a second spring seat. Selectively reciprocating plunger assembly comprises a piston end coupled to reciprocate in the oil chamber and a cam input end comprising a spring seat. A spring is biased between the spring seat and the second spring seat. The spring is configured to push the cam input end away from the plunger chamber. A sleeve is coupled around the oil control portion of the lifter body, and the sleeve is slidable between a lower position and an upper position to selectively block and unblock the oil ports.

An engine valve lifter for a type V engine comprises a plunger assembly, a lifter body, and a latch pin assembly. The plunger assembly is configured to reciprocate in a plunger chamber in response to mechanical pressure from a cam. The plunger assembly comprises a latch compartment. A lifter body comprises the plunger chamber surrounding the plunger assembly, a pair of fluid ports through the lifter body, and a pair of latch seats recessed in the plunger chamber. A latch pin assembly is in the latch compartment. The latch pin assembly comprises hydraulically actuated pins, a return spring biasing the pins together, and an extension spring pulling the pins together. The pins are biased to retract the latch seats in the latch compartment to unlock the plunger assembly from the lifter body, and the plunger assembly is slidable within the chamber. When hydraulic force is applied to the latch pin assembly through the pair of fluid ports, the latch pins extend in to the latch seats to lock the plunger assembly to the lifter body.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Figure 1A:
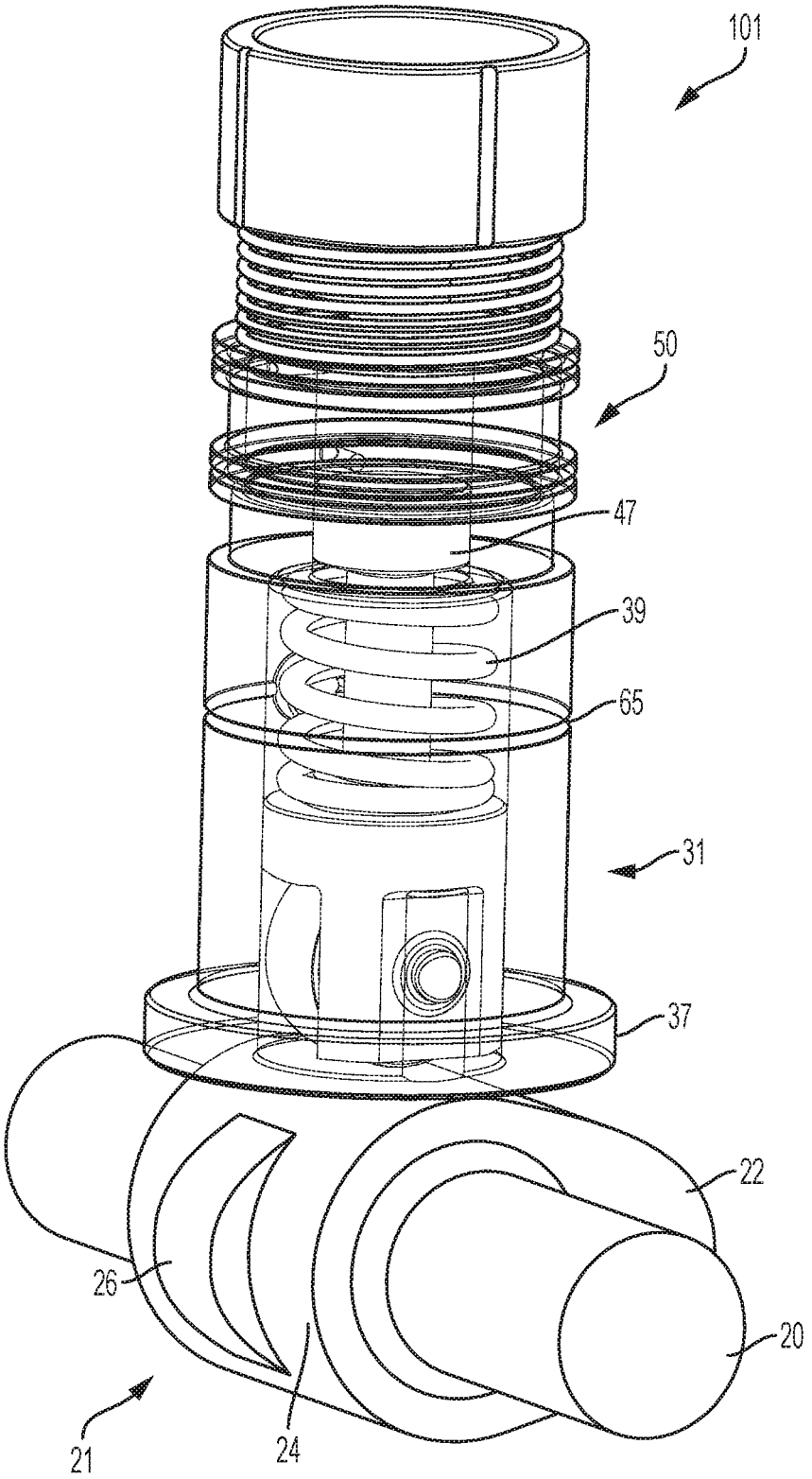
FIGS. 1A-1E are views of an engine valve lifter comprising a sleeve valve and a roller bearing assembly.

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures. Other implementations will be apparent to those skilled in the art from consideration of the specification and practice of the examples disclosed herein. For example, upper a lower port functionality can be reversed via appropriately biasing the springs and sleeve and porting the oil supply.

An engine braking lifter ("EB lifter") for a type V valve train system is disclosed. By tailoring the heights of the lift body, the plunger assembly, and the cam lobe profiles, other variable valvetrain functionality can be enabled, such as dual lift techniques, early exhaust valve opening (EEVO) and late exhaust valve closing (LEVC).

An engine braking ("EB") solution for type V valve train systems is discussed in reference to FIGS. 1A-1E. The engine valve lifter 101 comprises a sleeve valve 50 and a roller bearing assembly 60. A secondary braking is achieved by incorporating additional functionality to the lifter. The disclosure enables a vehicle to use a secondary braking system which in this case is called compression release engine braking. Engine braking helps a driver or autonomous vehicle control the speed of the vehicle without using the main or service brake, although it should be noted that EB is not a substitute for a service brake.

Lifter 101 comprises lifter body 30, plunger assembly 70, and a sleeve valve 50 which acts as a one way valve. Pressurized oil from an oil control valve ("OCV") is used to control the position of sleeve valve 50 thereby activating or deactivating engine braking. Integrating EB activation and deactivation mechanism along with the lifter simplifies the entire EB unit which also drastically reduces the overall cost of the unit.

Figure 3A:
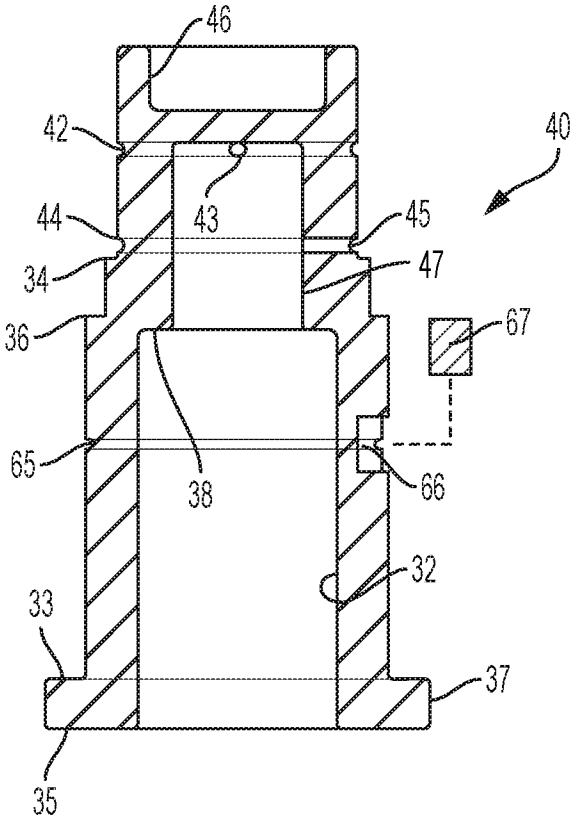
FIGS. 3A & 3B are views of the lifter body.
Figure 3B:
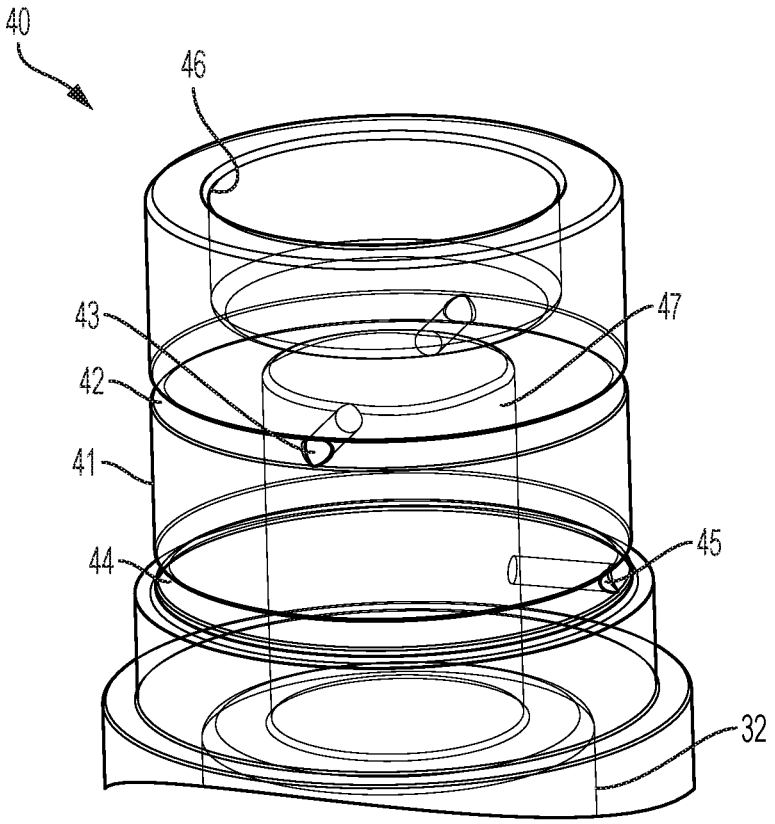

A lifter body 30 is an outer body and housing inside which the plunger assembly 70 is placed. Lifter body 30 comprises an oil control portion 40 shown in more detail in FIGS. 3A & 3B. Lifter body 30 comprises an exterior surface 41, oil ports 43, 45, and an interior oil chamber 47. The oil ports comprise at least one upper port 43 and at least one lower oil port 45. The number of oil ports is selectable, and two upper oil ports 43 and two lower oil ports 45 are drawn. Oil ports pass from the exterior surface 41, through the lifter body, and to the oil chamber 47 of the lifter body. The oil control portion 40 can further comprise an upper groove 42 in fluid communication with the at least one upper port 43 and a lower groove 44 in fluid communication with the at least one lower port 45. The exterior surface 41 can be stepped with a travel step 34 to restrict travel of a sleeve valve 50. Additional exterior steps can be included, such as an oil-receiving step 36, in the exterior surface 41. The oil-receiving step can be configured to distribute oil beneath the sleeve 53 and around a portion of the lifter body 30 to restrict fluid flow when the lifter 101 is installed in lifter bore 14 of an engine block 10. Additional steps and exterior surface changes can be included. For example, the circumference of the lifter can be chosen to permit a small amount of oil leak-down to lubricate the motion of the lifter 101 in the engine block 10 or to lubricate a cam 21 on a cam shaft 20.

Lifter body 30 further comprises a plunger interface end 31 comprising an interior plunger chamber 32 and a second spring seat 38. Plunger assembly 70 can selectively reciprocate within the lifter body 30 in this embodiment. Plunger chamber can comprise anti-rotation slots 69. Plunger interface end 31 and plunger chamber can terminate with a rim 37. Rim 37 can comprise a lift limit side 33 and a lobe-following side 35. The lobe-following side 35 is configured to follow the profile of a cam 21 as it rotates on a cam shaft 20. The lift limit side 33 is configured as a travel stop that restricts the lifter 101 from sliding up in to the lifter bore 14. The lobe-following side 35 can be configured to follow a primary or normal lift lobe 22 and return to base circle 24.

A sleeve valve 50 is configured with a sleeve 53 slidable along a portion of the exterior surface 41. The sleeve 53 is slidable between a lower position and an upper position to selectively block and unblock the oil ports 43, 45. The sleeve 53 is configured to selectively block and unblock the upper groove 42 and the lower groove 44. The lifter body 30 can comprise a cap seat 46. A cap 55 can be fixed to the cap seat, as by a press fit, crimp fit, snap ring, threading, or the like. The cap 55 can be used to bias a sleeve spring 51. In this example, sleeve spring 51 is between the cap 55 and the sleeve 53, and the sleeve spring 51 is configured to bias the sleeve 53 to the lower position.

Flow of oil in and out of oil chamber 47 through oil ports 43, 45 is controlled by the position of the sleeve 53. The position of the sleeve 53 is controlled by oil pressure from an oil controlled valve and hydraulic circuit. Sleeve 53 is coupled around the oil control portion 40 of the lifter body. Sleeve can comprise an upper lip 52 and a lower lip 54. The sleeve spring 51 can be restricted by the upper lip 52. The lower lip 54 can abut the travel stop 34 when the sleeve 53 is biased to the lower position. The lower lip 54 can jut out from the sleeve 53 a distance that restricts fluid flow when the lifter 101 is assembled in a lifter bore 14. Then, when a pressurized oil supply supplies pressurized oil to an oil control port 13 in the lifter bore 14 and to an oil cavity 15 in the lifter bore 14, the oil-receiving step 36 in the exterior surface 41 distributes oil beneath the lower lip 54 of the sleeve 53 and around a portion of the lifter body 30. When the oil is pressurized to a predetermined high level, the oil lifts the sleeve 53 to the upper position. When the oil is pressurized to a lower predetermined level, the spring force overcomes the oil pressure and the sleeve returns to the lower position.

Figure 2:
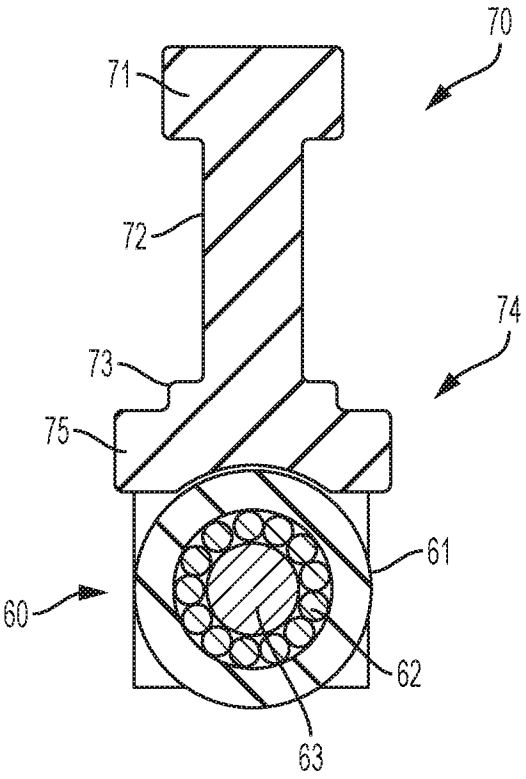
FIG. 2 is a view of a plunger comprising a roller bearing assembly.

Plunger assembly 70 selectively reciprocates in response to the oil pressure supplied to the oil control port 13 and to the position of the sleeve 53. The plunger assembly comprises in this example a cam input end 74 comprising a spring seat 73 and a piston end 71 coupled to reciprocate between the oil chamber 47 and a piston seat 48. Piston seat 48 can be a bore within the lifter body 30 between the oil chamber 47 and the plunger chamber 32. FIG. 2 shows the plunger assembly 70 separate from the lifter body 30.

A neck 72 can connect the piston end 71 to the cam input end 74. A plunger spring 39 can seat against the spring seat 73, can surround the neck 72, and can bias against the second spring seat 38 in the plunger chamber 32. Based on design choice, plunger spring 39 is biased between the second spring seat 38 and the spring seat 73, and the plunger spring 39 is configured to push the cam input end 74 away from the plunger chamber 32. So, the piston end 71 can be biased by the plunger spring 39 to withdraw from the oil chamber 47 and permit pressurized oil to fill the oil chamber 47. Piston end 71 seals oil chamber 47, and when the plunger assembly 70 rises during a lift event, piston end 71 pushes against trapped oil or piston end 71 pushes oil out an oil port 43 during a lost motion event such as when EB is not active.

Cam input end comprises a plunger body 75 which in this example comprises a roller bearing assembly 60. Roller bearing assembly 60 is used mainly to reduce frictional losses. Bearing assembly 60 comprises a roller 61 surrounding optional bearings 62 on a bearing axle 63. Bearing axle 63 can be configured with axle extensions 64 to extend in to anti-rotation slots 69 within the plunger chamber. Alternatively, additional anti-rotation pins or other means can be included to prevent the cam input end 74 or other aspects of the plunger assembly 70 from rotating with respect to the lifter body 30.

Bearing assembly 60 is configured for following a rotating cam profile of a cam 21. In the example of FIGS. 1A-1E, the bearing is narrow compared to the width of the cam 21. While the rim 37 of the lifter body 30 is configured to follow a base circle 24 and primary lift lobe 22, a variable valve lift event is configured as a secondary lift lobe 26. In this example, secondary lift lobe 26 is a brake event lobe, though other options such as EEVO & LEVC are possible to configure for.

It is the position of sleeve 53 of the sleeve valve 50 that controls flow of oil in and out of oil chamber 47. On one side of the sleeve 53, the sleeve spring 51 exerts force due to preload, and from other side of the sleeve 53 it is the pressure of oil that exerts force on the sleeve 53. The sleeve 53 moves up and down according to these two forces acting on it.

Figure 1C:
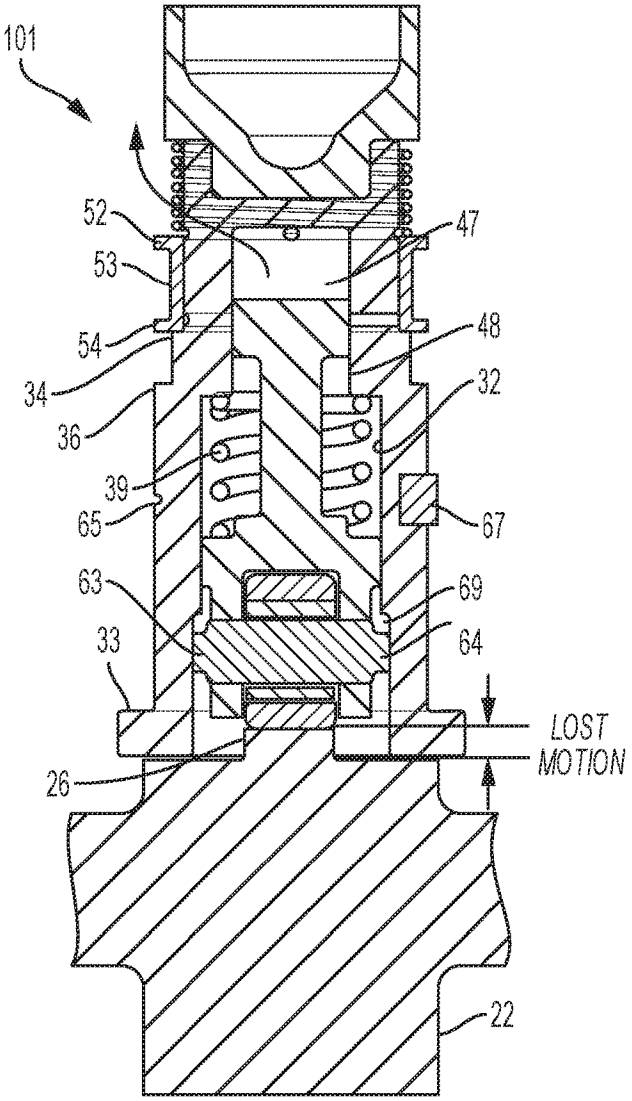
Figure 1B:
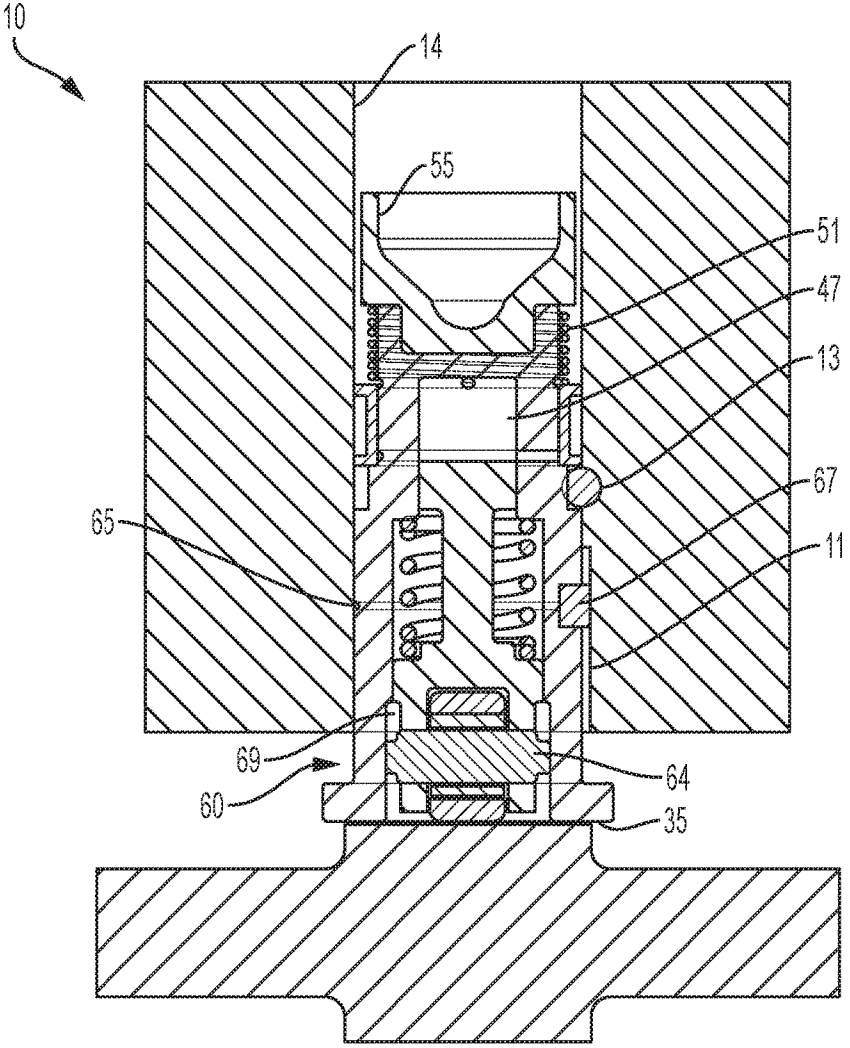

The unactuated state is shown in FIG. 1A and the sleeve 53 is in the lower position. Pressurized oil from, for example, an oil control valve ("OCV") or other component of a hydraulic control circuit, is used to control the position of sleeve valve 50. When the OCV is off, oil pressure is low and sleeve 53 is pushed down by the sleeve spring 51 which is preloaded. This is seen in FIGS. 1B & 1C. The sleeve 53 rests on the travel step 34 and the lower oil port 45, which functions as an oil inlet orifice, is closed. The upper oil port 43 is open. When the secondary lift lobe 26 rotates against roller 61, the plunger assembly 70 moves up in to the lifter body 30. The oil in oil chamber 47 is pushed out the upper oil port 43 because there is no resistance from sleeve 53. The plunger spring 39 collapses, and the spring force is such that the lifter body 30 does not rise with the secondary lift lobe 26. No movement is transferred to the lifter body. The lift of the plunger assembly 70 is "lost motion." This is seen in FIG. 1C.

Figure 1E:
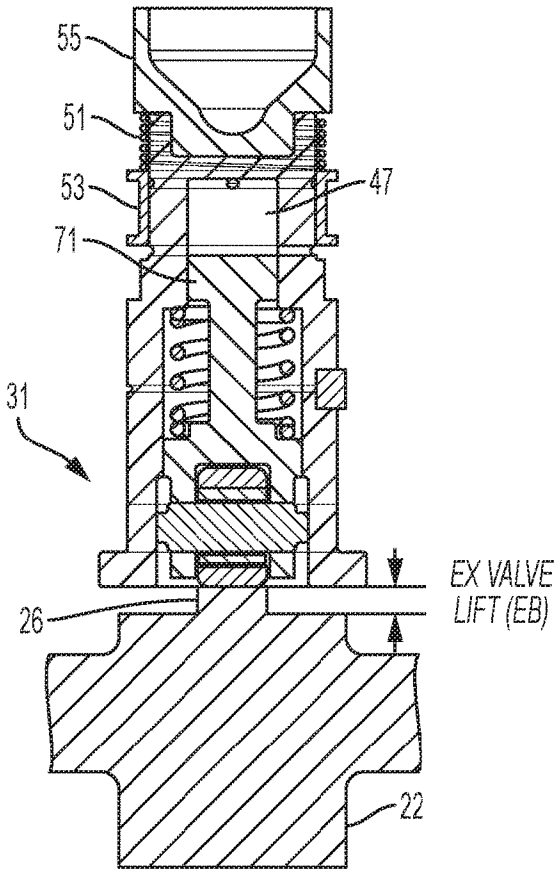
Figure 1D:
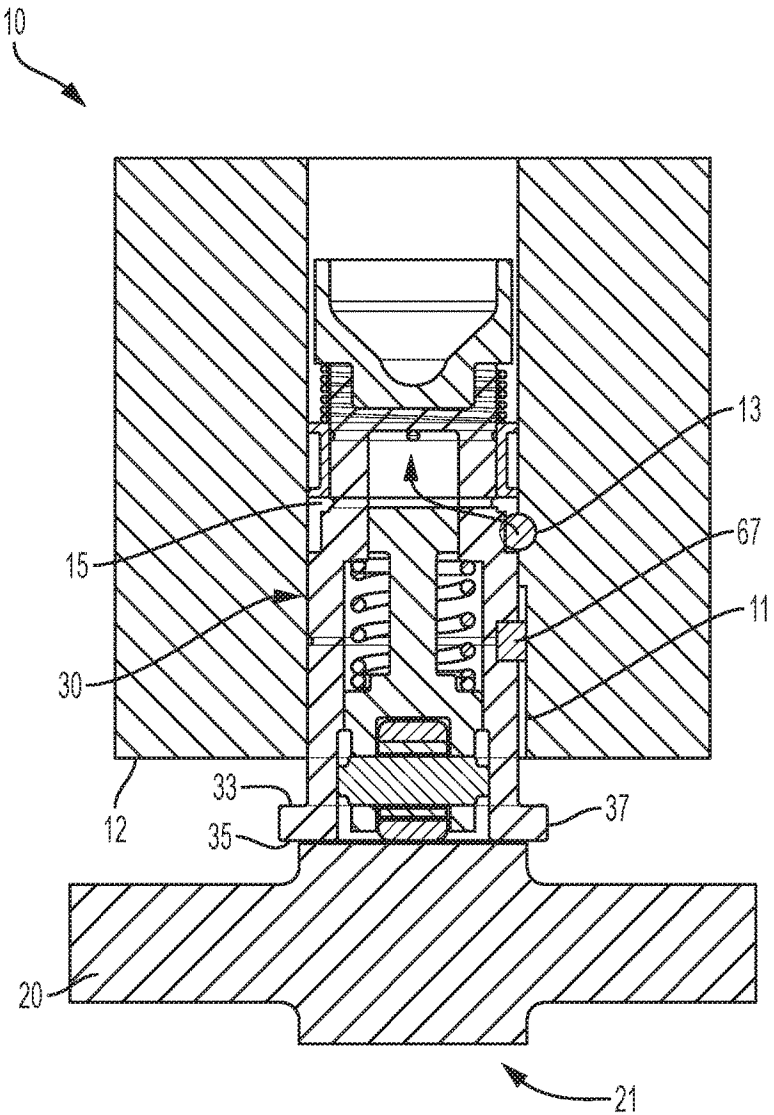

When the OCV is on, pressurized oil is supplied to push the sleeve 53 up against the spring force of the sleeve spring 51. This closes the at least one upper oil port 43 which serves as an exit orifice of oil chamber 47. This also opens the at least one lower oil port 45 which serves as an inlet orifice to the oil chamber 47. Oil enters oil chamber 47 and fills the oil chamber 47 through the inlet orifice. This is seen in FIG. 1D. When secondary lift lobe 26 hits roller 61, as shown in FIG. 1E, plunger end 71 moves up. Due to the incompressibility of oil, oil chamber 47 acts as a rigid body and in turn pushes lifter body 30. The cap 55 affixed to lifter body 30 pushes a pushrod coupled to a rocker arm coupled to a valve, such as an exhaust valve. Engine braking can occur on this action by the secondary lift lobe 26. To perform engine braking, the opening of the valve is timed immediately after the compression stroke of the piston in the affiliated cylinder. Thereby, energy spent in compressing charge air is lost to perform engine braking.

A benefit of the sleeve valve 50 lifter 101 is that it does not require a reset function, so it is not necessary to cycle the cam to return to normal operation after a variable valve lift event.

Figure 4:
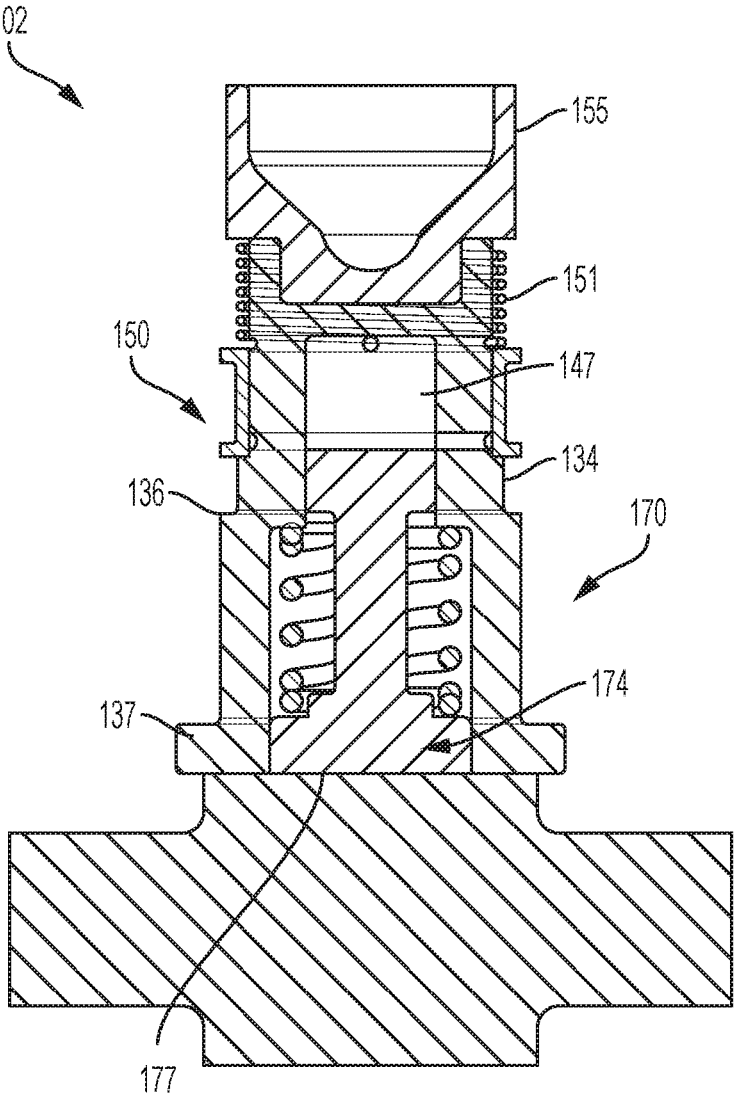
FIG. 4 is a view of an engine valve lifter comprising a sleeve valve and a flat tappet style assembly.
Figure 5:
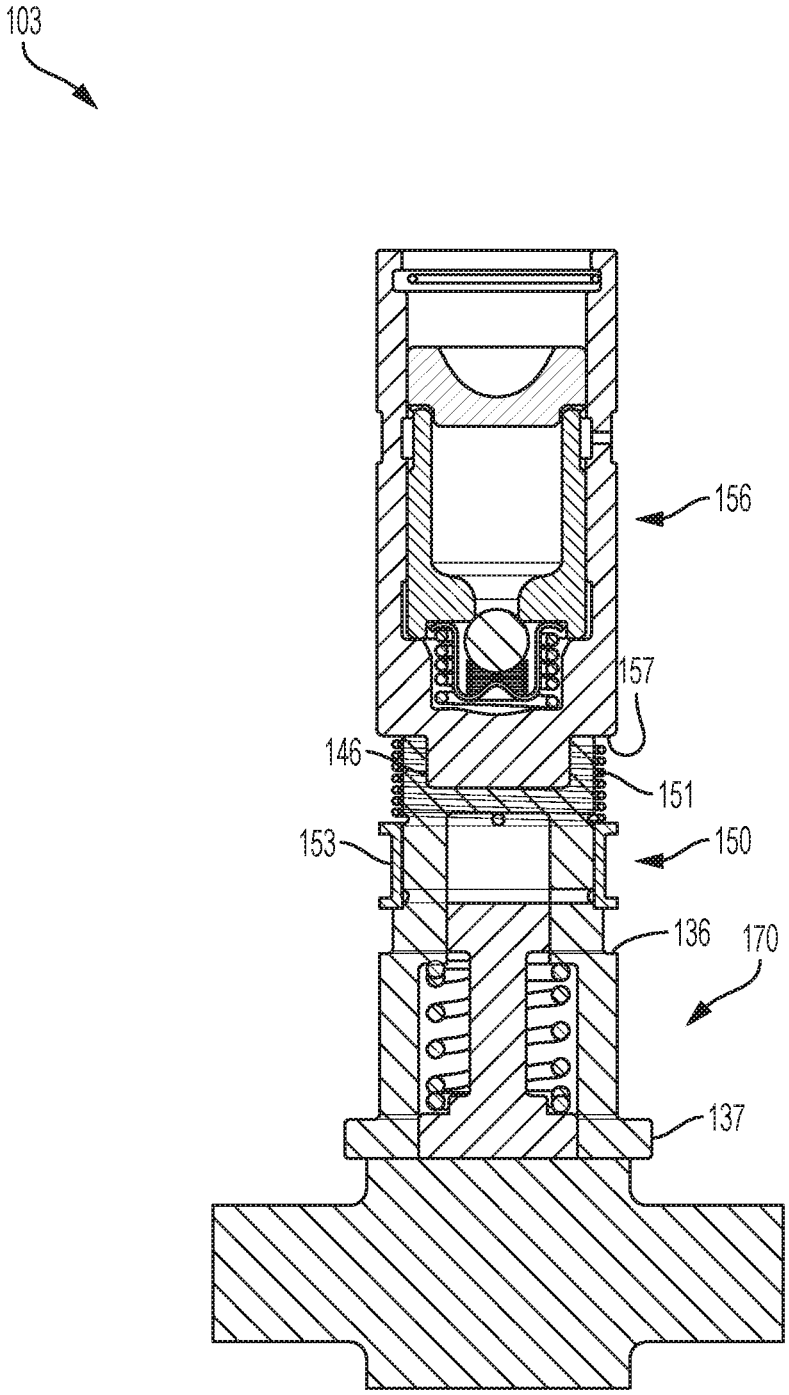
FIG. 5 is a view of an engine valve lifter comprising a sleeve valve, a flat tappet style assembly, and a hydraulic lash adjuster.

Turning to FIGS. 4 & 5, a plunger assembly 170 of engine valve lifters 102 & 103 can comprise a flat 177 for forming a flat tappet style on cam input end 174. This shortens the lifter body 130 over the prior example, but other aspects of a rim 137, travel step 134, oil-receiving step 136, and sleeve valve 150 are the same as above. In FIG. 4, a cap 155 is used to bias sleeve spring 151, but in FIG. 5, a hydraulic lash adjuster ("HLA") 156 comprises the cap mounted to the cap seat 146. The interfacing end of the HLA 156 is stepped to comprise a spring step 157. The sleeve spring 151 is biased against the spring step 157 on the HLA and against the upper lip of the sleeve 153.

An alternative lifter 104 with a lifter body 230 and plunger assembly 270 is shown in FIGS. 12A-14. The cap 255, sleeve valve 250, and roller bearing assembly 260 are the same as the above examples. The lifter body 230 is modified so that the plunger interface end 231 comprises an extension 237 that necks-down. The exterior of the lifter body is stepped to comprise a travel step 234, and oil-receiving step 236, a bore width step 235, and a step down at the extension 237. The bore width step 235 is sized to guide the lifter body within the lifter bore 14 and to restrict fluid flow between the lifter body 230 and the lifter bore 14.

Instead of the plunger assembly 70 being wholly enclosed by the lifter body 30, the plunger assembly 270 receives a portion of the extension 237 while the lifter body 230 receives the piston end 271 of the plunger assembly. The cam input end 274 comprises a guide cup 276 around the spring seat 273. The plunger spring 239 can seat against the interior plunger chamber 232. When the spring collapses or expands, the extension 237 is configured to reciprocate in the guide cup 276.

The earlier alternatives can comprise an anti-rotation feature such as a clip or pin 67 in a groove 66 in the lifter body and a lubrication groove 65 in the lifter body 30. The anti-rotation pin 67 can lift and lower in anti-rotation groove 11 in the lifter bore 14. In the alternative of FIGS. 12A-14, the anti-rotation feature such as a clip or pin 268 is in groove 266 of the plunger body 275 for lifting and lowering in the anti-rotation groove 11 of the lifter bore. A lubrication groove 265 can be included in the plunger body 275.

The sleeve valve 250 can work the same as other sleeve valves disclosed herein. But, when the oil control is off, and low pressure is at the oil control port 13, there is no distinguishing on the cam 221 between the lifter body and the plunger assembly. In the embodiment of FIGS. 12A-14, the primary lift lobe 222 is as wide as the roller 261 of the roller bearing assembly 260. So too, the secondary lift lobe 226 is as wide as the roller 261 of the roller bearing assembly 260. The prior examples had a thin secondary lift lobe 26 and a wide primary lift lobe 22. The wide roller 261 is acting on the wide secondary lift lobe 226. The location for the lost motion can move within the engine block 10.

Figure 12A:
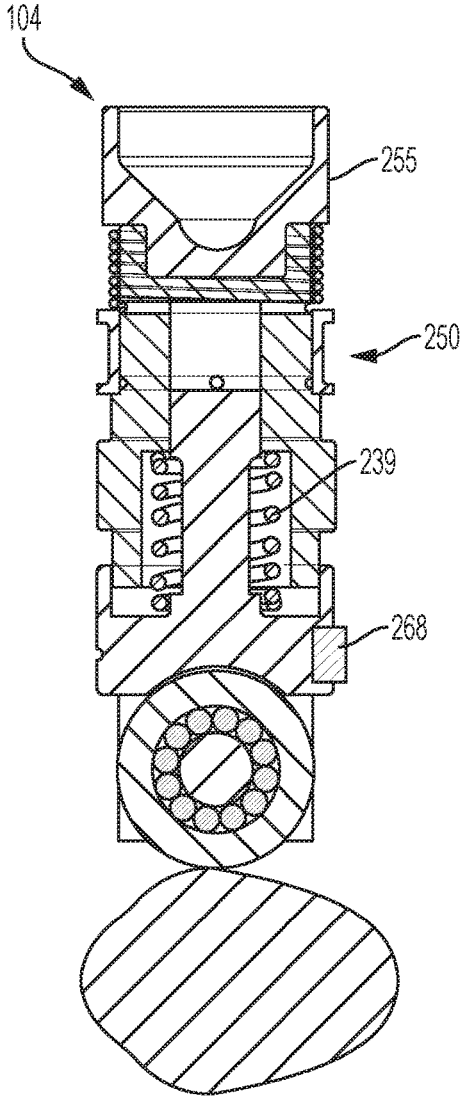
FIGS. 12A-12D are views of an engine valve lifter comprising a sleeve valve, a plunger comprising a roller bearing assembly and a plunger cup, and an lifter body extension guided in the plunger cup.
Figure 12B:
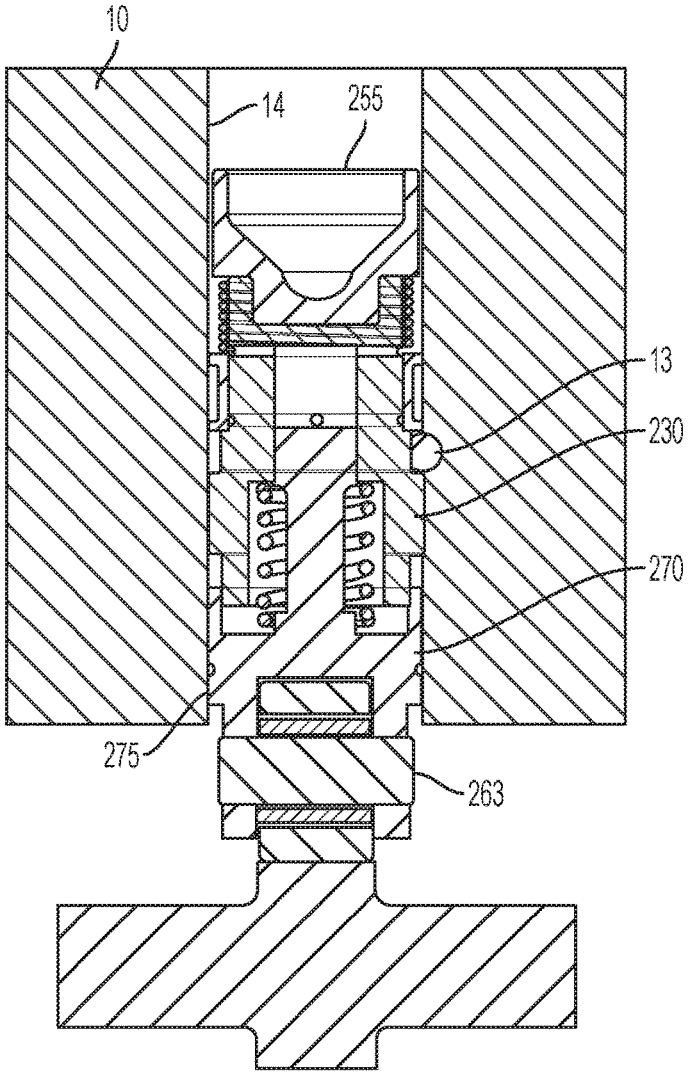
Figure 12C:
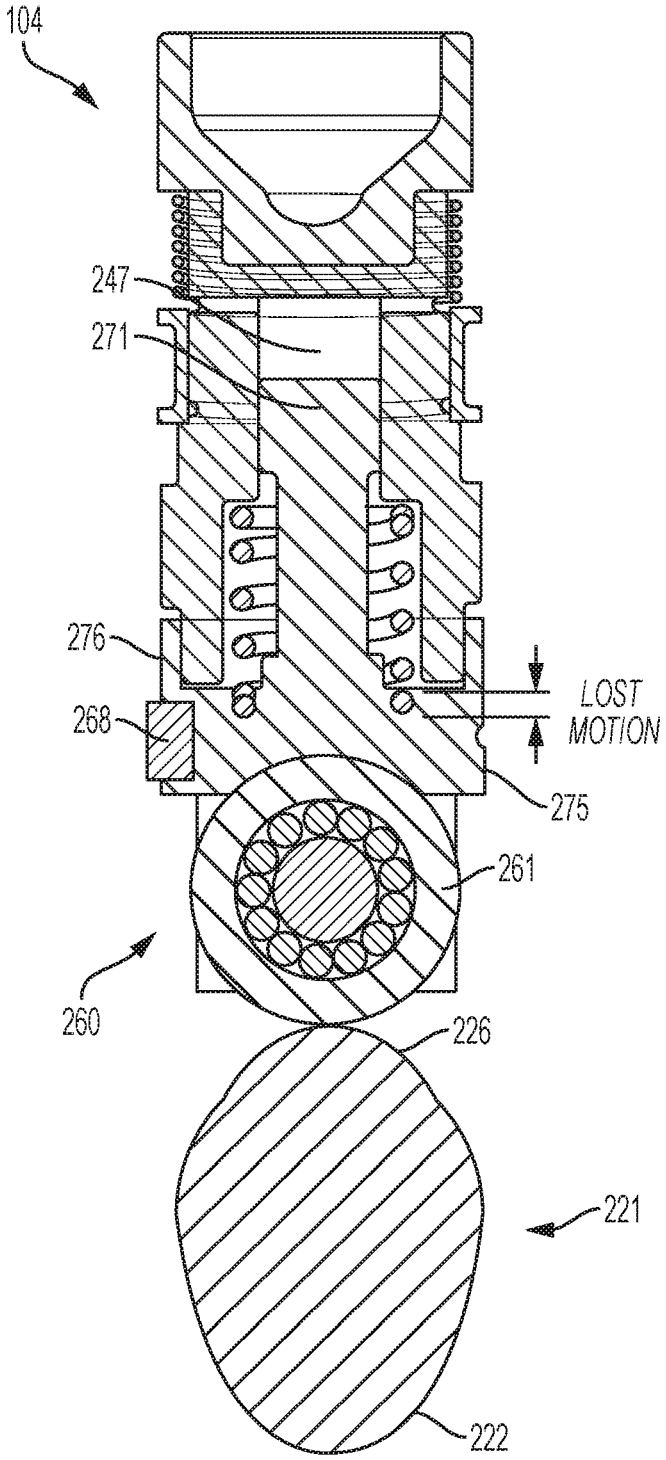
Figure 12D:
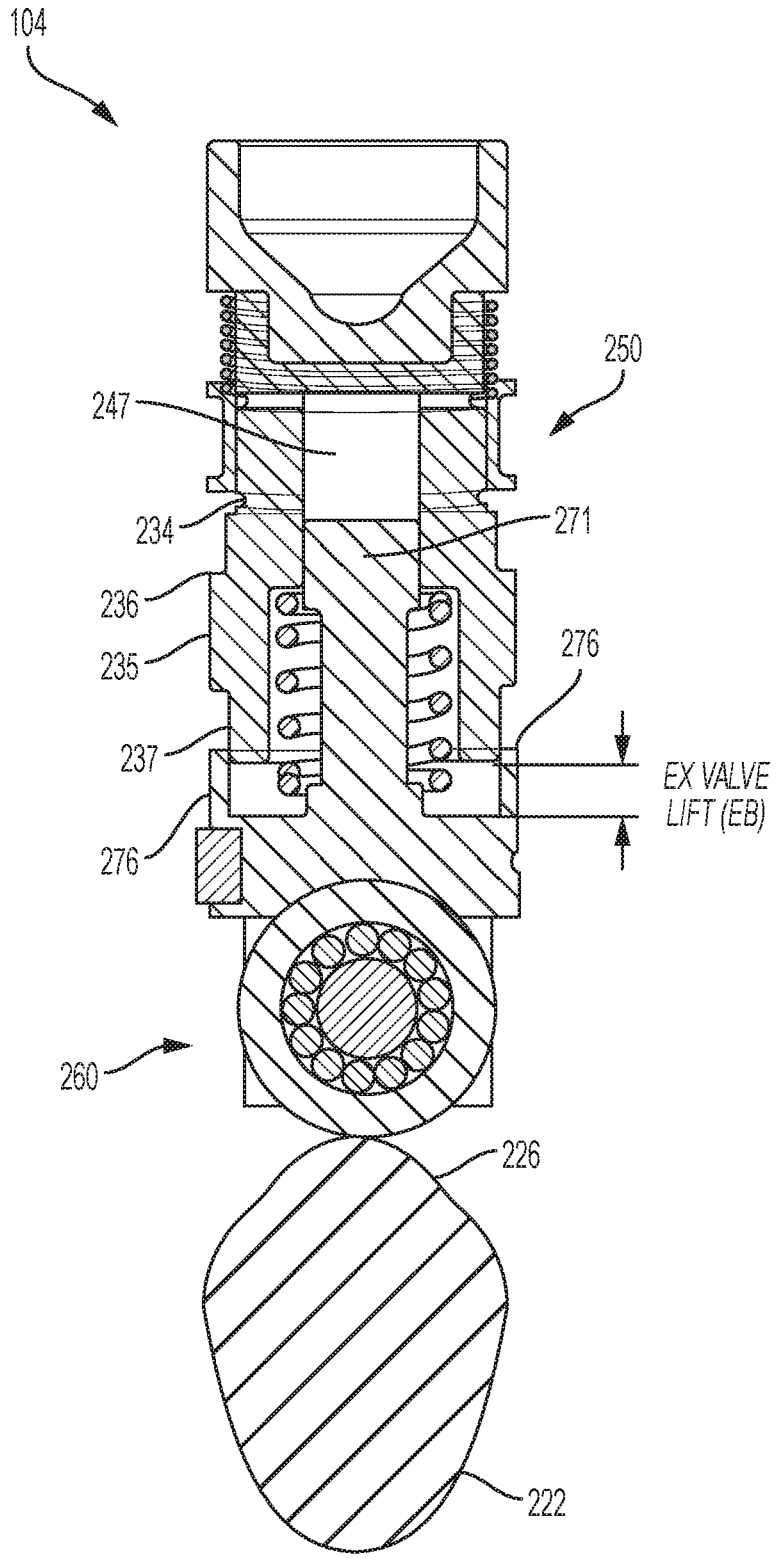

FIG. 12A shows a zero input condition with the sleeve valve biased to the lower position. FIG. 12B shows the zero input condition within the engine block 10. FIG. 12C shows the lifted condition for the plunger assembly 270 with lost motion shown due to the secondary lift lobe 226 lifting the plunger assembly 270 while there is low pressure fed to the oil control port 13. Oil can exit the oil chamber 247 through the upper oil ports 243. In FIG. 12D, however, engine braking occurs and the exhaust valve is lifted the amount shown according to the secondary lift lobe profile. The piston end 271 cannot enter the oil chamber 247 because the upper oil ports 243 are blocked while high pressure oil is fed to the lower oil ports 245.

Figure 13:
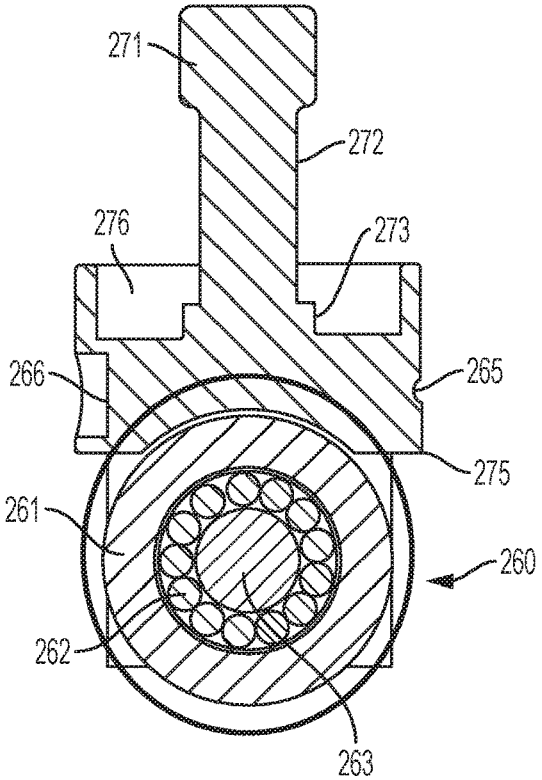
FIG. 13 is a view of a plunger comprising a roller bearing assembly and a plunger cup.

FIG. 13 shows the plunger assembly 270 with the bearing assembly 260 with the roller 261, bearings 262, and bearing axle 263 in the plunger body 275, which function like their counterparts in earlier figures.

Figure 14:
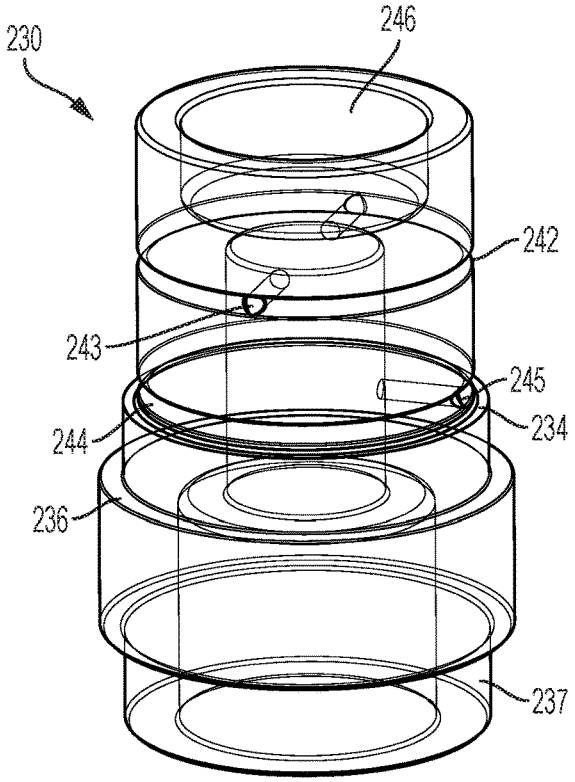
FIG. 14 is a view of a lifter body with an extension.

FIG. 14 shows the lifter body 230 with cap seat 246, upper groove 242, lower groove 244, upper oil ports 243, lower oil ports 245 and various steps in the external surface, including travel step 234, and oil-receiving step 236, which function like their counterparts in the above figures.

In a first aspect, an engine braking device for a type V engine comprises an inner plunger assembly configured to reciprocate in response to oil pressure, spring pressure, and cam lobe profiles. A lifter body surrounds the inner plunger assembly, and the lifter body comprises an upper oil port, a lower oil port, and an oil chamber. A portion of the inner plunger can reciprocate within the oil chamber. A slidable sleeve surrounds the lifter body and can reciprocate between a position blocking the upper port and a position blocking the lower port. The engine braking device is configured to transfer force from a rotating cam pressing on the inner plunger to a valve stem above the upper port.

In a second aspect, the device can comprise a bearing axle and a bearing on the bearing axle. The bearing axle passes through the inner plunger and provides an anti-rotation feature between the inner plunger and the lifter body.

In a third aspect, an engine braking device for a type V engine comprises an inner plunger configured to reciprocate in response to mechanical pressure. The inner plunger comprises a latch compartment. A lifter body surrounds the inner plunger, and the lifter body comprises a fluid port through the lifter body. A portion of the inner plunger can reciprocate within the chamber. A latch pin assembly 580 is in the latch compartment. The latch pin assembly comprises hydraulically actuated pins 581 configured to reciprocate in the latch compartment, a return spring 582 to bias the pins together, and an extension spring 583 biasing the pins apart. The pins are biased to extend out from the latch compartment to lock the inner plunger and lifter body together. But, when hydraulic force is applied to the latch pin assembly through the fluid port, the pins move together to unlatch the latch pins from the lifter body and permit the portion of the inner plunger to reciprocate within the chamber. The third aspect is enabled by the lifters 105, 106, 107 of FIGS. 6A-11B.

Figure 6A:
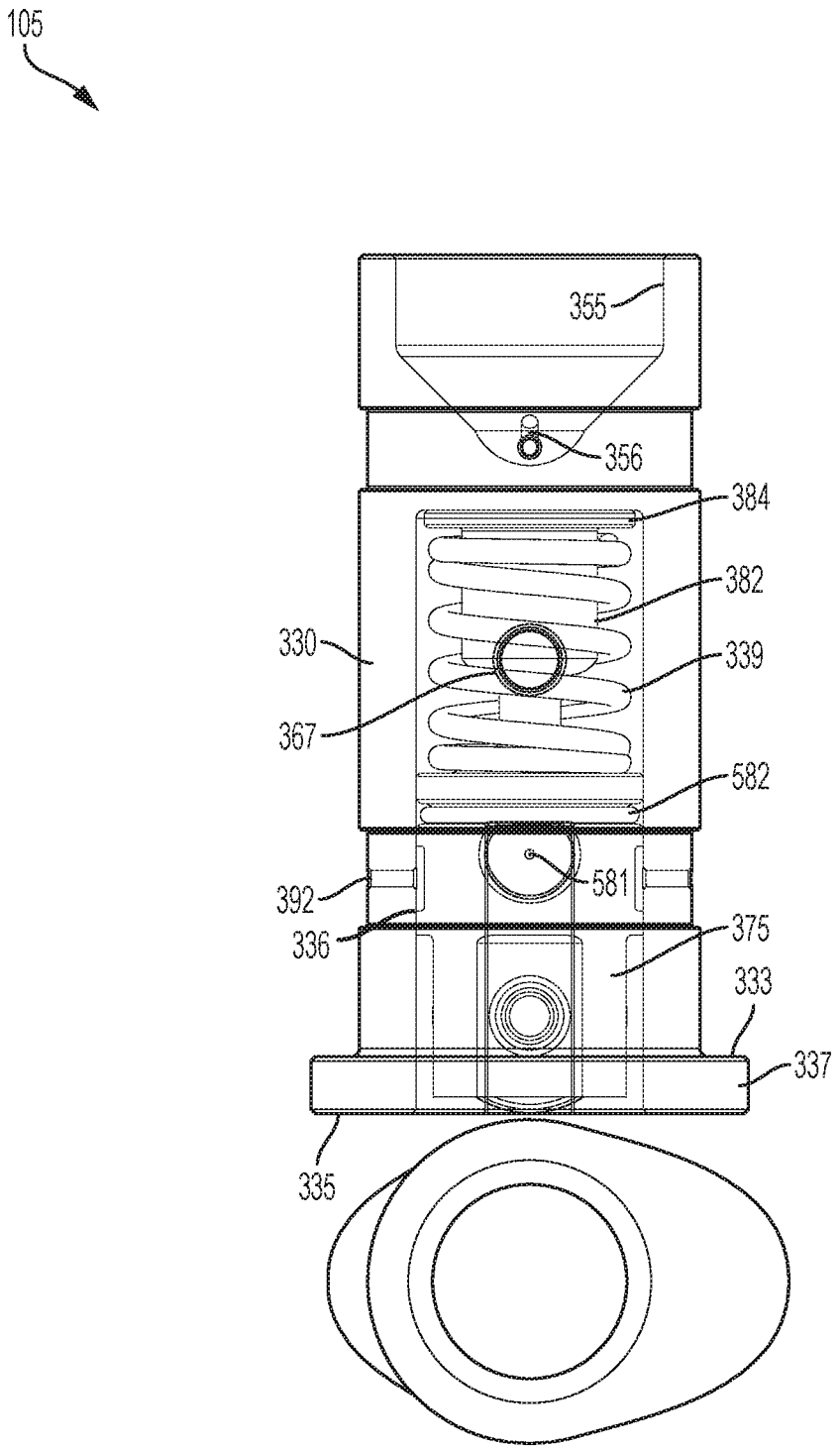
FIGS. 6A & 6C are views of an engine valve lifter comprising a latching capsule in the plunger assembly and a roller bearing assembly.
Figure 6B:
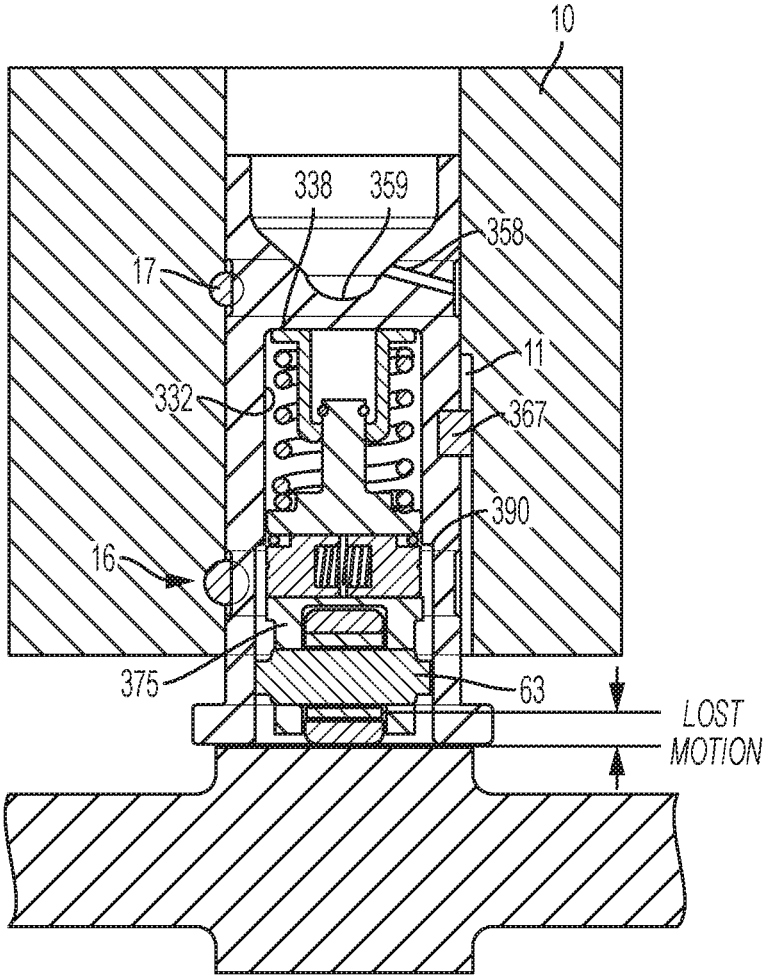

As an alternative, an engine valve lifter 105, 106, 107 for a type V engine can comprise a plunger assembly 370, 470, a lifter body 330, 430, and latch pin assembly 580. Turning first to FIGS. 6A & 6B, the plunger assembly 370 is configured to reciprocate in a plunger chamber 332 in response to mechanical pressure from a cam 321. The plunger assembly 370 comprises a latch compartment 379 with latch oil ports 390 leading thereto through the plunger body 375. Oil-receiving steps 391 can be included in the plunger body 375 to direct oil to the latch oil ports 390 and distribute oil around the plunger body 375.

Plunger assembly can further comprise a neck 372 with a notch 378 at a first end and a spring seat 373 at an end nearest the plunger body 375. The plunger assembly 370 can interface with a hat-shaped holder 385 comprising a brim 384 seated against the upper limit 338 of the plunger chamber 332. The brim 384 can serve as a locator and spring seat to locate the plunger spring 339 with respect to the plunger chamber 332. The holder 385 can comprise a sideband portion 382 forming a tubular spring guide and the crown can comprise a hole 383 in the tip of the crown. A plunger spring 339 can be seated against the brim 384 and the plunger spring 339 can extend over the holder sideband 382 to bias against the spring seat 373 of the plunger assembly 370. The neck 372 of the plunger assembly extends through the hole 383 in the tip, and the holder can serve as a guide for the plunger assembly as the plunger assembly lifts and lowers in the plunger chamber 332. The neck 372 can comprise a notch 378 and a retainer 380 seated in the notch can secure the plunger notch 378 in the holder. An optional cushion or seal 381 can be seated also in the holder 385.

A lifter body 330 is the housing inside which plunger assembly 370 is placed. Lifter body 330 comprises the plunger chamber 332 surrounding the plunger assembly 370. An upper limit 338 is formed in the chamber. A spring guide in the form of a hat-shaped holder 385 is seated against the upper limit 338. A plunger spring 339 is seated around the holder 385 to bias the plunger assembly 370 and lifter body apart. Plunger chamber 332 further comprises a pair of latch seats 396 recessed in a wall of the plunger chamber. The pair of latch seats 396 can comprise anti-rotation slots in the plunger chamber. A pair of fluid ports 392 pass through the lifter body 330. An oil control port 16 in the engine block can supply pressurized fluid to the pair of fluid ports 392 via an oil-receiving step 336 adjacent the pair of fluid ports through the lifter body. The oil-receiving step 336 is configured to distribute oil around a portion of the lifter body.

A latch pin assembly 580 is installed in the latch compartment 379. The latch pin 580 assembly comprises hydraulically actuated pins 581, a return spring 582 biasing the pins 581 together, and an extension spring 583 pulling the pins 581 together. The plunger assembly 370 can further comprise a spring recess 377 to seat the return spring 582. The return spring 582 can be in the form of a band. The pins 581 can be biased to retract from the latch seats 396 in the latch compartment 332 to unlock the plunger assembly 370 from the lifter body 330 to make the plunger assembly slidable within the chamber. When there is no pressurized fluid inside the latch compartment 379, latch pins 581 are pulled towards each other by the extension return spring 583 and the plunger assembly 370 is disengaged from lifter body 330. When a cavity 584 is filled by pressurized oil, pins 581 move away from each other against the spring loads and the plunger assembly 320 is engaged to lifter body 330. When hydraulic force is applied to the latch pin assembly 580 through the oil control port 16, through the pair of fluid ports 392, and through the latch oil ports 390, the latch pins 581 extend in to the latch seats 396 to lock the plunger assembly 370 to the lifter body 330.

In FIGS. 6A-11B, the piston assemblies 370 & 470 interface with oil controlled latch pin assemblies 580. This provides an engine braking solution or dual lift capability for type V valve train systems. Pressurized oil from a hydraulic control circuit such as one comprising an oil control valve (OCV) is used to engage or dis-engage the latch pin assembly 580 and there by activate or deactivate a variable valve lift function such as engine braking.

The lifter body 330 in FIGS. 6A-11B further comprises a lubrication port 356, 456 to a pushrod seat 359, 459. Oil control port 17 can supply oil to the lubrication port 356, 456. At times, lubrication can come down a pushrod and lubricate the pushrod, such as with a cap 55 or HLA 56, 456 designs.

Additional lifter body 330, 430 features can comprise an anti-rotation feature such as a pin 367 for projecting into an anti-rotation groove 11 of an engine block. Lifter body can also comprise a rim 337, 437 comprising a lift limit side 333, 433 and a lobe-following side 335, 435. The lobe-following side is configured to follow a rotating cam profile, whereas the lift limit side is configured as a travel stop.

Cam shaft 320, 420 in this case comprises a cam 321, 421 with two lobes, a primary lift lobe 322, 422 and a secondary lift lobe 326, 426. Primary lift lobe 322, 422 extends all along the width of the cam 321, 421 whereas secondary lift lobe 326, 426 is located midway on the cam 321, 421 with a width slightly lesser than the width of the flat 477 or roller 361 used. By way of example, pressurized oil from an OCV is used to control the position of latching pins 581. When OCV is off, oil pressure is low and pins 581 are pulled towards each other. In this case, plunger assembly 370, 470 and lifter body 330, 430 are disengaged and move independently of each other. During a disengaged condition, when secondary lift lobe 326, 426 of the cam 321, 421 hits the plunger assembly 370, 470, plunger assembly 370, 470 alone moves up to compress plunger spring 339, 439 thereby transferring no lift to the lifter body 330, 430. Lost motion occurs as indicated in FIG. 6B. Engine braking is off in this scenario. The valve is lifted and lowered by the primary lift lobe 322, 422 via pushrod, rocker arm, etc.

Figure 6C:
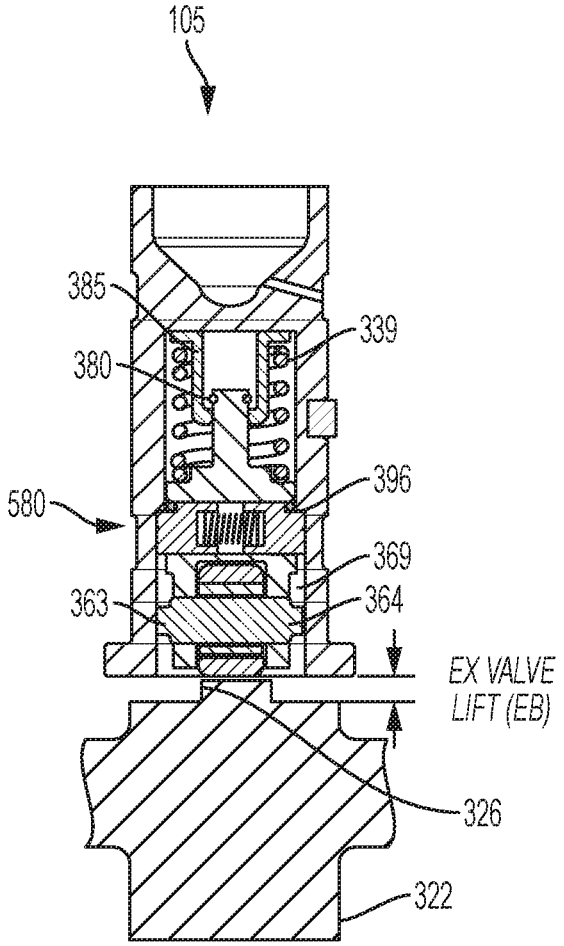

When OCV is on, pressurized oil pushes latch pins 581 away from each other and lifter body 330 gets engaged with plunger assembly 370. During the engaged condition, when secondary lift lobe 326, 426 hits the bearing 361 or flat 477 of the plunger assembly 370, 470, the entire lifter assembly moves up which in turn opens the affiliated exhaust valve for a brief period of time. Engine braking is active, and an example lift is shown in FIG. 6C. For engine braking, the opening of the exhaust valve is timed immediately after a compression stroke of a piston in a combustion cylinder. Thereby, energy spent in compressing charge air is lost to atmosphere to perform engine braking. Adjusting the timing of the secondary lift lobe permits other variable valve techniques.

Figure 7:
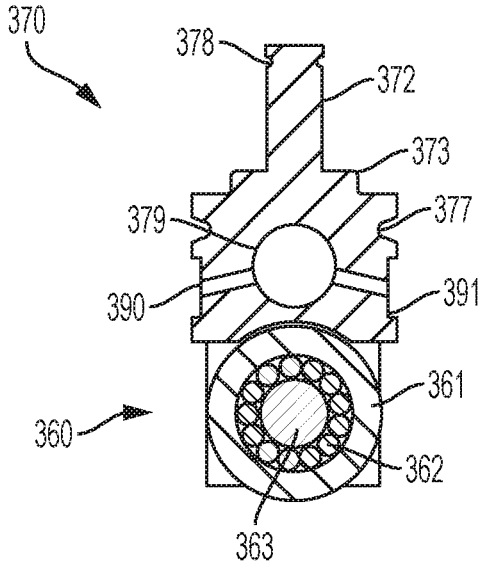
FIG. 7 is a view of a plunger comprising a latching capsule and a roller bearing assembly.
Figure 8:
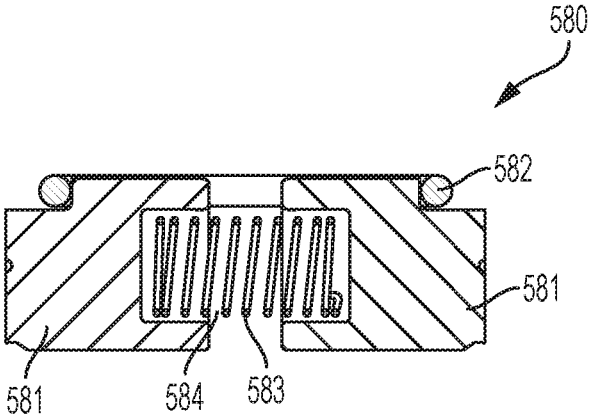
FIG. 8 is a cross-section of latching capsule.
Figure 9:
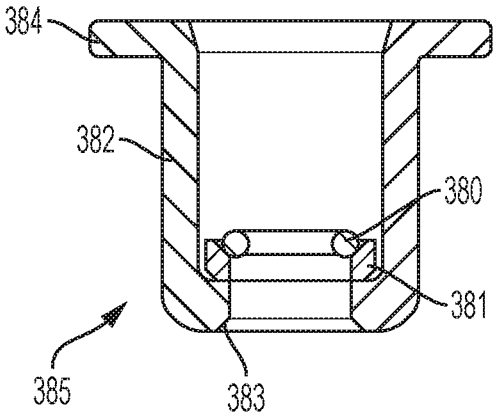
FIG. 9 is a cross-section of a holder assembly.
Figure 10B:
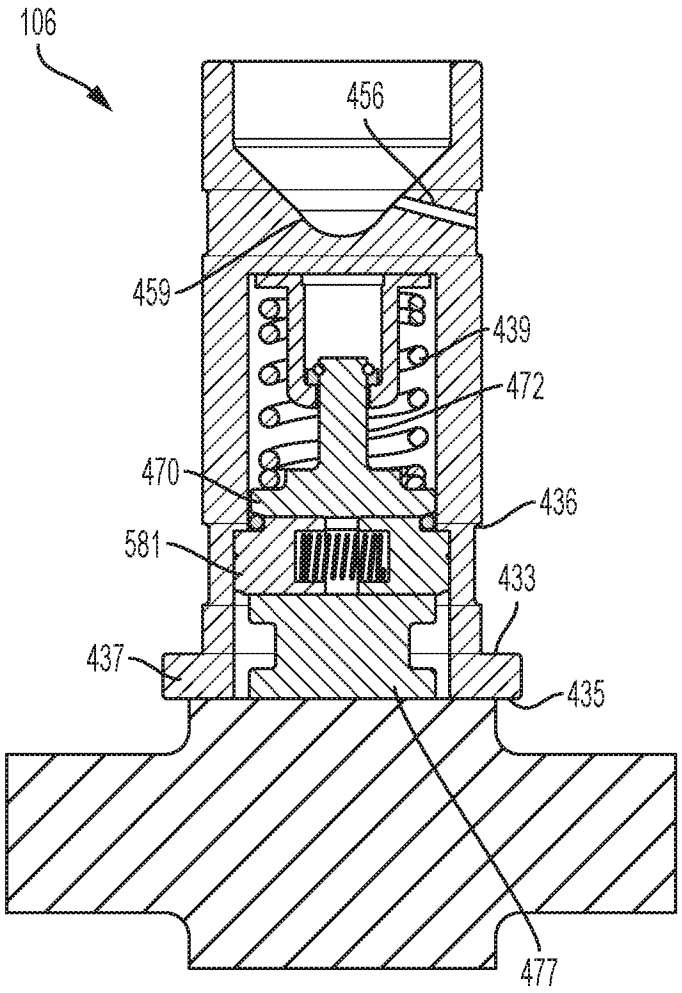
FIGS. 10A & 10B are views of an engine valve lifter comprising a latching capsule and a flat tappet style assembly.
Figure 10A:
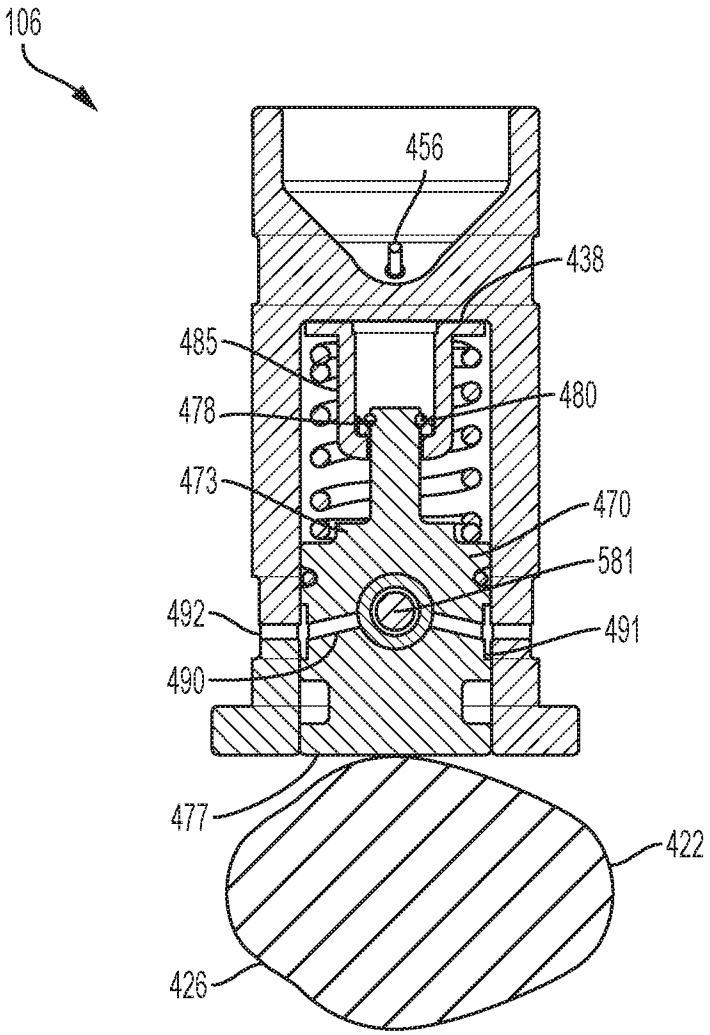

FIGS. 6A-7 comprise a plunger assembly 370 with a roller bearing assembly 361 on a cam input end of a plunger body 375 that functions like the earlier embodiments via roller 361, optional bearings 362, and bearing axle 363. The bearing assembly 361 is configured for following the profile of a rotating cam. As an additional option, the pair of latch seats 396 recessed in the plunger chamber 332 can comprise anti-rotation slots 369 in the plunger chamber. The bearing axle 363 can comprise axle extensions 364 extending in to the anti-rotation slots 369.

The alternatives of FIGS. 10A-11B use a flat 477 to form a flat tappet style on the cam input end of the plunger assembly 470. The plunger assembly 470 shares many similarities to the plunger assembly 370, such as the latch compartment 479, latch oil ports 490, oil-receiving steps 491, spring seat 473, neck 472, notch 478 and retainer 480.

Figure 11A:
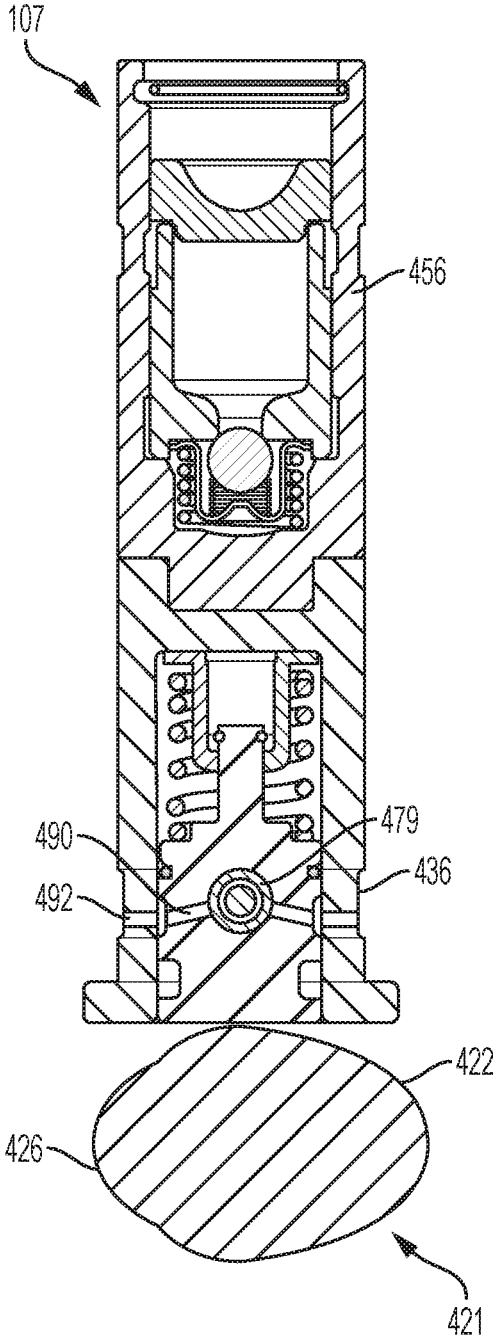
FIGS. 11A & 11B are views of an engine valve lifter comprising a latching capsule, a flat tappet style assembly, and a hydraulic lash adjuster.
Figure 11B:
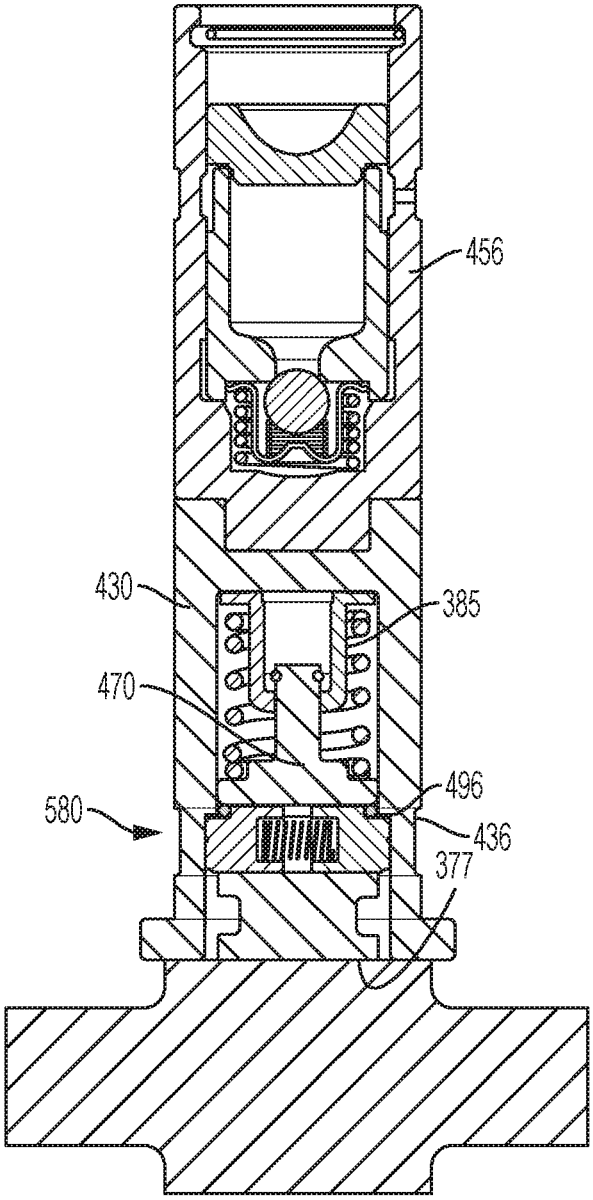

As shown in FIGS. 11A & 11B, an HLA 456 can be integrated with the lifter body 430. The HLA 456 can be press-fit or otherwise affixed to the lifter body 430.

Additional design considerations can comprise that no reset function is needed with the disclosed designs. There is also room to design options with no added lift. Another design alternative comprises that, when EB is off, there can be a loss of lift during the exhaust stroke as the plunger assembly collapses over the primary lobe 22, 222, 122, 322, 422. For this reason, the lift profile of the primary lift lobe could be greater than intended for the actual valve lift. The profile of the cam 21 could be designed for higher lift. So, when EB is on, the exhaust valve lift during the exhaust stroke can be greater than the actual intended valve lift. Then, modifications can be made on the piston top in order to avoid the valve hitting the piston. Also, the disclosed alternatives can enable techniques including EEVO & LEVC. The alternative designs are compatible with reset functions for when the customer does not want added lift. The alternative designs are compatible with intervening cycle techniques to come down from an added lift engine braking to go to a normal lift exhaust profile.

What is claimed is:

1. A lifter assembly, comprising:

a lifter body, comprising:

an oil control portion comprising an exterior surface, oil ports, and an interior oil chamber, wherein the oil ports pass from the exterior surface, through the lifter body, and to the oil chamber; and a plunger interface end comprising an interior plunger chamber and a second spring seat;

a selectively reciprocating plunger assembly comprising:

a piston end configured to reciprocate in the oil chamber; and a cam input end comprising a spring seat;

a spring biased between the spring seat and the second spring seat, the spring configured to push the cam input end away from the plunger chamber; and a sleeve around the oil control portion, the sleeve configured to slide between a lower position and an upper position to selectively block and unblock the oil ports.

2. The lifter assembly of claim 1, wherein the oil ports comprise at least one upper oil port and at least one lower oil port.

3. The lifter assembly of claim 2, wherein the oil control portion further comprises an upper groove in fluid communication with the at least one upper oil port and a lower groove in fluid communication with the at least one lower oil port, and wherein the sleeve is further configured to selectively block and unblock the upper groove and the lower groove.

4. The lifter assembly of claim 1, wherein the lifter body further comprises a cap seat, and wherein the lifter assembly further comprises a cap in the cap seat.

5. The lifter assembly of claim 4, further comprising a sleeve spring between the cap and the sleeve, and wherein the sleeve spring is configured to bias the sleeve to the lower position.

6. The lifter assembly of claim 5, further comprising an oil-receiving step in the exterior surface, and wherein the oil-receiving step is configured to distribute oil beneath the sleeve and around a portion of the lifter body.

7. The lifter assembly of claim 6, further comprising a pressurized oil supply configured to supply pressurized oil to the oil-receiving step to lift the sleeve to the upper position.

8. The lifter assembly of claim 4, wherein the cap comprises a hydraulic lash adjuster.

9. The lifter assembly of claim 1, wherein the cam input end further comprises a flat, and wherein the flat is configured to follow a rotating cam profile.

10. The lifter assembly of claim 1, wherein the cam input end further comprises a bearing assembly on a bearing axle, and wherein the bearing assembly is configured to follow a rotating cam profile.

11. The lifter assembly of claim 10, wherein the plunger chamber further comprises anti-rotation slots, and wherein the bearing axle extends into the anti-rotation slots.

12. The lifter assembly of claim 1, wherein the plunger interface end further comprises a rim comprising a lift limit side and a lobe-following side, wherein the lobe-following side is configured to follow a rotating cam profile, and wherein the lift limit side is configured as a travel stop.

13. The lifter assembly of claim 1, wherein the cam input end further comprises a guide cup around the spring seat, wherein the plunger interface end comprises an extension, and wherein the extension is configured to reciprocate in the guide cup.

14. The lifter assembly of claim 13, wherein a portion of the plunger assembly is further configured to project into an anti-rotation groove of an engine block.

15. The lifter assembly of claim 1, wherein a portion of the lifter body is configured to project into an anti-rotation groove of an engine block.

16. A lifter assembly, comprising:

a plunger assembly configured to reciprocate in a plunger chamber, the plunger assembly comprising:

a latch compartment;

a neck comprising a notch;

a retainer in the notch; and a spring seat;

a lifter body comprising:

the plunger chamber surrounding the plunger assembly;

a pair of fluid ports through the lifter body; and a pair of latch seats recessed in the plunger chamber;

a latch pin assembly in the latch compartment, the latch pin assembly comprising hydraulically actuated pins;

a hat-shaped holder comprising a brim seated against the plunger chamber, wherein the holder comprises a hole in a tip; and a plunger spring seated against the brim and extending over the holder to bias against the spring seat, wherein the neck extends through the hole in the tip, and wherein the retainer is in the holder.

17. The lifter assembly of claim 16, wherein the plunger assembly further comprises a spring recess and a return spring seated in the spring recess, and wherein the return spring comprises a band surrounding a portion of the hydraulically actuated pins.

18. The lifter assembly of claim 17, wherein the latch pin assembly further comprises a cavity and an extension spring in the cavity, and wherein the extension spring is configured to pull the hydraulically actuated pins into the latch compartment.

19. The lifter assembly of claim 16, wherein:

the hydraulically actuated pins are configured to retract from the pair of latch seats to unlock the plunger assembly from the lifter body to thereby configure the plunger assembly to slide within the chamber, and when hydraulic force is applied to the latch pin assembly through the pair of fluid ports, the hydraulically actuated pins are configured to extend into the pair of latch seats to lock the plunger assembly to the lifter body.

20. The lifter assembly of claim 16, further comprising a hydraulic lash adjuster.

21. The lifter assembly of claim 16, wherein the plunger assembly further comprises a cam input end comprising a flat, and wherein the flat is configured to follow a rotating cam profile.

22. A lifter assembly, comprising:

a plunger assembly configured to reciprocate in a plunger chamber, the plunger assembly comprising:

a latch compartment; and a bearing assembly on a bearing axle, wherein the bearing axle comprises axle extensions;

a lifter body comprising:

the plunger chamber surrounding the plunger assembly;

a pair of fluid ports through the lifter body;

a pair of latch seats recessed in the plunger chamber; and anti-rotation slots in the plunger chamber; and a latch pin assembly in the latch compartment, the latch pin assembly comprising hydraulically actuated pins, wherein the axle extensions extend into the anti-rotation slots.

23. The lifter assembly of claim 22, further comprising an oil-receiving step adjacent to the pair of fluid ports, wherein the oil-receiving step is configured to distribute oil around a portion of the lifter body.

24. The lifter assembly of claim 22, wherein the lifter body further comprises a rim comprising a lift limit side and a lobe-following side, wherein the lobe-following side is configured to follow a rotating cam profile, and wherein the lift limit side is configured as a travel stop.

25. The lifter assembly of claim 22, wherein a portion of the lifter body is configured to project into an anti-rotation groove of an engine block.

26. The lifter assembly of claim 22, wherein the lifter body further comprises a lubrication port to a pushrod seat.

27. The lifter assembly of claim 22, wherein:

the hydraulically actuated pins are configured to retract from the pair of latch seats to unlock the plunger assembly from the lifter body to thereby configure the plunger assembly to slide within the chamber, and when hydraulic force is applied to the latch pin assembly through the pair of fluid ports, the hydraulically actuated pins are configured to extend into the pair of latch seats to lock the plunger assembly to the lifter body.

28. The lifter assembly of claim 27, wherein the plunger assembly further comprises a spring recess and a return spring seated in the spring recess, and wherein the return spring comprises a band surrounding a portion of the hydraulically actuated pins.

* * * * *